US007182216B2

(12) United States Patent
Reinoso

(10) Patent No.: US 7,182,216 B2
(45) Date of Patent: Feb. 27, 2007

(54) DRINKING-CUP FOR BEVERAGE CONSUMPTION, AND USE FOR TASTING CHAMPAGNE

(75) Inventor: Pablo Reinoso, Malakoff (FR)

(73) Assignee: Veuve Clicquot Ponsardin - Maison Fondee En 1772, Reims (FR)

( * ) Notice: Subject to any disclaimer, the term of this patent is extended or adjusted under 35 U.S.C. 154(b) by 492 days.

(21) Appl. No.: 10/474,784

(22) PCT Filed: Apr. 11, 2002

(86) PCT No.: PCT/FR02/01274

§ 371 (c)(1),
(2), (4) Date: Mar. 16, 2004

(87) PCT Pub. No.: WO02/083517

PCT Pub. Date: Oct. 24, 2002

(65) Prior Publication Data

US 2004/0140315 A1 Jul. 22, 2004

(30) Foreign Application Priority Data

Apr. 18, 2001 (FR) ..... 01 05250

(51) Int. Cl.
*A47G 19/22* (2006.01)

(52) U.S. Cl. ..... 220/713

(58) Field of Classification Search ..... None
See application file for complete search history.

(56) References Cited

U.S. PATENT DOCUMENTS

| | | | | |
|---|---|---|---|---|
| 2,059,070 A * | 10/1936 | Wershay | ..... | 220/717 |
| 2,252,915 A | 8/1941 | Conill | | |
| 5,871,118 A | 2/1999 | Franzese | | |

FOREIGN PATENT DOCUMENTS

| | | |
|---|---|---|
| DE | 851610 | 10/1952 |
| DE | 3017789 | 11/1981 |
| DE | 158323 | 3/2003 |
| FR | 1110132 | 2/1956 |

* cited by examiner

*Primary Examiner*—Stephen J. Castellano
(74) *Attorney, Agent, or Firm*—Leydig, Voit & Mayer, Ltd.

(57) ABSTRACT

A drinking-cup placed on a bottle containing a beverage to be consumed. The drinking-cup has a hollow body pierced by a beverage intake, an air intake, and a mouth, and defined by a wall with an annular cross-section enclosing an axis. A closure wall is arranged obliquely relative to the axis. The air intake and the mouth are in respective connecting zones and form an open angle and a closed angle between the wall having an annular cross-section and the closure wall. The wall with an annular cross-section is a surface of rotation and flares out at some distance from the beverage intake. A mid-plane connecting the air intake to the mouth forms, with the axis, an angle not less than 30 degrees. The cup is particularly applicable to champagne tasting.

11 Claims, 3 Drawing Sheets

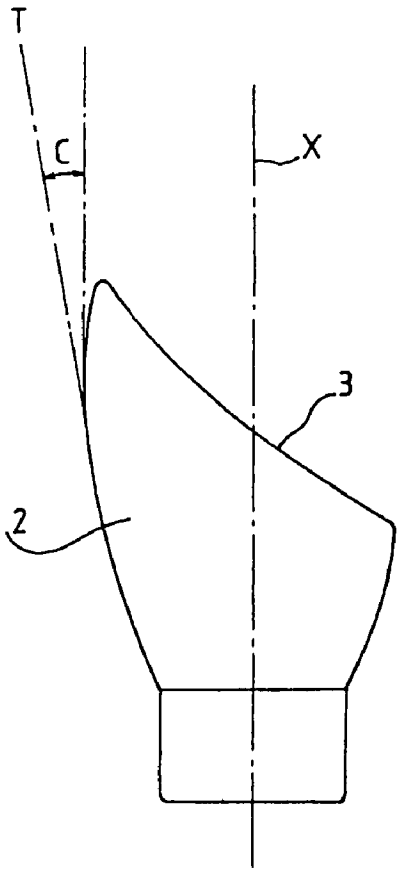
Fig. 3
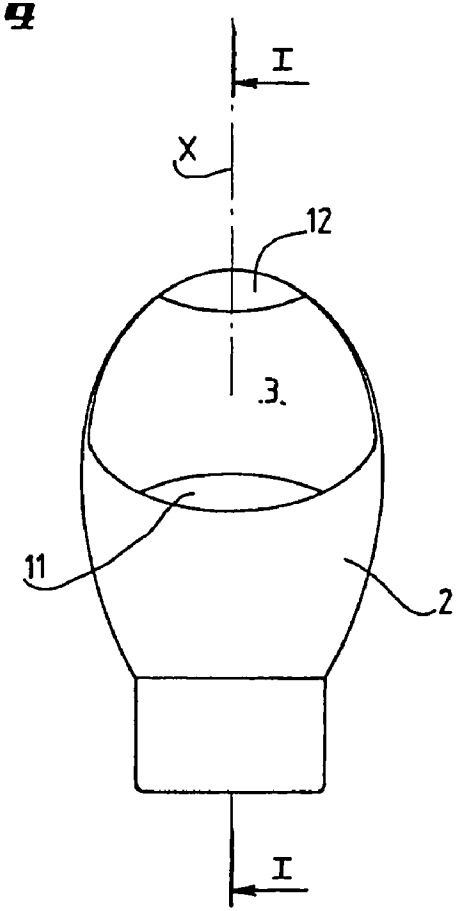
Fig. 2
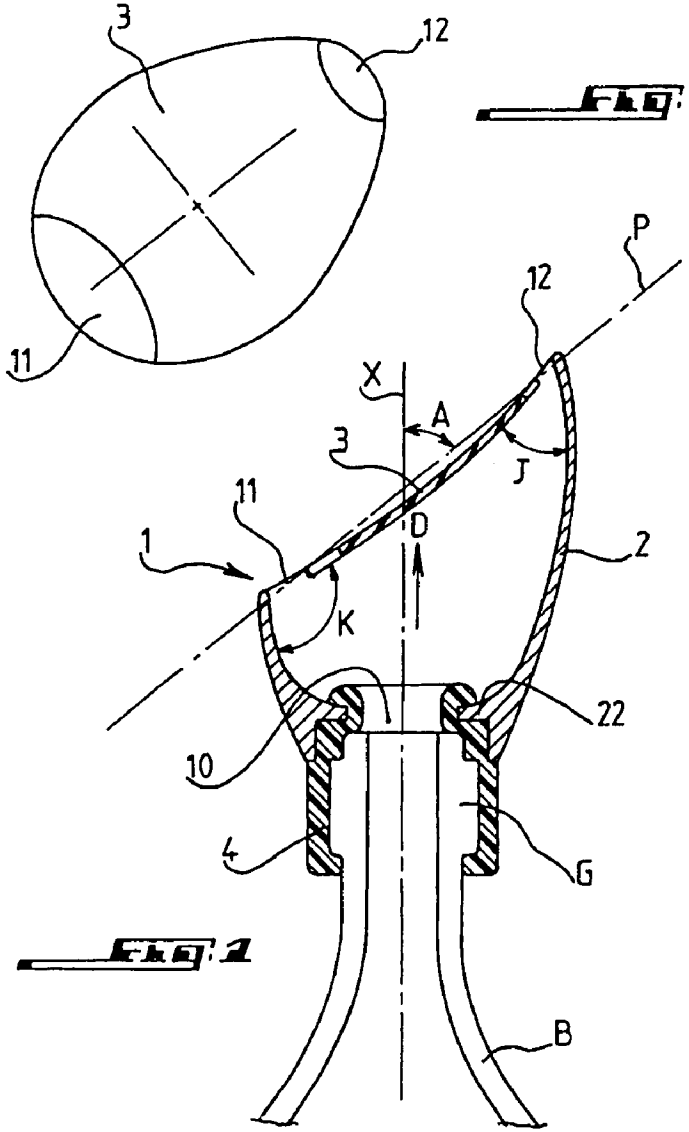
Fig. 1
Fig. 4

DRINKING-CUP FOR BEVERAGE CONSUMPTION, AND USE FOR TASTING CHAMPAGNE

FIELD OF THE INVENTION

The invention generally relates to the field of accessories for consumption of beverages, and in particular of sparkling wines and champagne.

More precisely, the invention relates to a drinking cup that allows a beverage to be consumed directly from a container holding it, this cup being intended to be fitted in a removable manner on the container, and forming a hollow body penetrated by a beverage inlet centered on an axis, an air inlet, and a mouth opening, this hollow body having a wall with an annular cross section surrounding the axis and a closing wall, connected to the wall with annular cross section obliquely with respect to the axis, the air inlet and the mouth opening being respectively relatively near and relatively far from the beverage inlet in an axial direction, and one or both of the air inlet and the mouth opening being contiguous to the wall to annular cross section and to the closing wall.

BACKGROUND

A drinking cup of the type to which the invention relates is described, for example, in the patent document U.S. Pat. No. 4,574,970.

More generally, numerous types of end fittings intended to facilitate beverage consumption are known, as evidenced in particular by the patent documents FR-2 222 976, CH-649 511, DE-U-299 17 965, DE-30 17 789, U.S. Pat. No. 3,085,710, FR-2 657 846, GB-505 207 and DE-26 41 874.

Two specific problems arise in the design of such end fittings when they are intended to allow one to taste sparkling wines or champagne directly from a container such as a bottle, that is to say, without the use of a glass.

The first problem relates to the regulation of the known phenomenon, in the case of champagne, of considerable foam formation produced by the more or less abrupt manipulation of the bottle.

In effect, after opening a bottle, the champagne contained therein, because of the decompression it undergoes, can spontaneously form more or less abundant foam, in particular in the event of impact, and can thus produce an overflow of the liquid out of the bottle.

It is therefore necessary to control this overflow in order to make possible consumption of the sparkling beverage, such as a spackling wine or champagne, directly from the container holding it, in particular a bottle, without risk to the consumer or to those around him of being sprayed with it.

The second problem relates to the quality of the taste of the beverage, and in particular of the champagne, in spite of the absence of a glass.

In effect, under conventional tasting conditions, not only does the act of pouring the champagne into a glass release a part of its gaseous charge, but also the glass offers the champagne contained in it an open and relatively large volume that fosters regulation of the loss of gas.

In the case in which champagne is drunk directly from the bottle, it is therefore also necessary to control the formation of foam, generated in particular by the inclination of the bottle, in order to allow its contents to be consumed under satisfactory conditions from the tasting standpoint.

SUMMARY OF THE INVENTION

In this context, the invention aims to propose a drinking cup that is particularly well suited to consumption of a sparkling beverage, particularly sparkling wine or champagne, and which meets the requirements mentioned in the preceding.

For this purpose, the drinking cup of the invention, includes a wall with an annular cross section that is a surface of revolution, flaring out at a distance from the beverage inlet, wherein a mid-plane joining the air inlet to the mouth opening forms an angle with the axis that is, at most, 60 degrees.

Preferably, the air inlet and the mouth opening are both contiguous to the wall of annular cross section and to the closing wall.

The air inlet and/or the mouth opening can each be formed by a slot made in the closing wall, this slot advantageously being curved and having a concavity facing away from the axis.

In order to increase the effectiveness of control of the spray, the angle formed by the mid-plane joining the air inlet with the mouth opening is preferably between 30 and 60 degrees, and is preferably 50 degrees.

Furthermore, the wall with annular cross section advantageously has a flaring out that decreases with increasing distance from the beverage inlet, with it being possible for this flaring out to be followed by a narrowing to form a basin in the wall capable of collecting a certain volume of beverage.

The drinking cup of the invention is advantageously produced at least partially out of a flexible material, which can be fitted tightly on the container.

The drinking cup of the invention is ideally applicable to tasting a bottled beverage, in particular champagne, with the beverage inlet of the cup being fitted on the neck of the bottle.

Other characteristics and advantages of the invention will emerge clearly from the description of it given in the following, in an indicative and non-limiting way, with reference to the appended drawings in which:

BRIEF DESCRIPTION OF DRAWINGS

FIG. 1 is a view in median axial section of a drinking cup according to a first embodiment of the invention, this section being along I—I of FIG. 2, and with the cup being represented after having been fitted on a bottle;

FIG. 2 is an external front view of the cup illustrated in FIG. 1;

FIG. 3 is an external side view of the cup illustrated in FIGS. 1 and 2;

FIG. 4 is a top view of the cup illustrated in FIG. 1, this cup being observed perpendicularly to the mid-plane P marked in FIG. 1;

DETAILED DESCRIPTION

As stated in the preceding, the drinking cup of the invention is intended to be fitted in a removable manner on bottle B containing a beverage to be consumed, such as champagne, in order to allow this beverage to be consumed without a glass, in a controlled manner.

Figure 6:
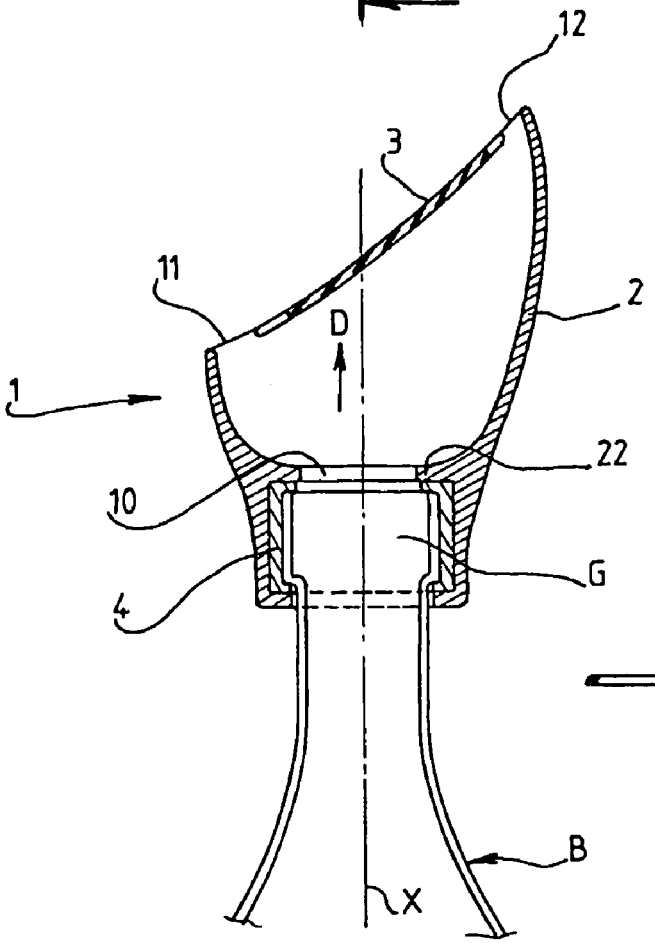
FIG. 6 is a view in median axial section of the cup illustrated in FIG. 5, this section being along VI—VI of FIG. 5, and with the cup being represented after having been fitted on a bottle.

As shown particularly in FIGS. 1 and 6, this cup 1 takes the form of a hollow body that is penetrated by beverage inlet 10, air inlet 11, and mouth opening 12 which the consumer places in his mouth.

In use, beverage inlet 10 of the cup is centered on axis of symmetry X of bottle B and of its neck G.

The interior volume of this cup is delimited by wall 2 with annular cross section that surrounds axis X, and by closing wall 3 that, with the exception of air inlet 11 and mouth opening 12, is connected in a sealed manner to wall 2 with annular cross section.

As shown in particular in FIGS. 1 and 6, closing wall 3 is in fact connected to wall 2 with annular cross section according to an oblique angle of incidence with respect to axis X, so that in the plane of these figures, walls 2 and 3 form between them, relatively farther from beverage inlet 10 measured along an axial direction D, a relatively closed angle J, and, relatively closer to beverage inlet 10, a relatively open angle K.

Air inlet 11 is formed in the zone of connection of walls 2 and 3 where these walls form between them the open angle K, whereas mouth opening 12 is formed in the zone of connection of walls 2 and 3 where these walls form between then the closed angle J.

According to a first aspect of the invention, wall 2 with annular cross section is a surface of revolution that flares out some distance from beverage inlet 10, so that the foam formed by the beverage coming out of neck G of bottle B can be spent while spreading out.

According to a second aspect of the invention, the mid-plane P (FIG. 1) that joins air inlet 11 with mouth opening 12 forms, with axis X, an angle A that is at most 60 degrees, thereby opposing expansion of the foam by the presence of a solid screen that allows it to collapse.

Even more advantageously, the angle A formed by the mid-plane P joining air inlet 11 with mouth opening 12 is between 30 and 60 degrees, and is preferably equal to 50 degrees, this inclined position of plane P promoting collapsing of the foam.

In the preferred embodiment of the invention, air inlet 11 and mouth opening 12 are both contiguous to the wall 2 with annular cross section and to closing wall 3, each of these openings being formed by a slot in the edge of closing wall 3.

Figure 5:
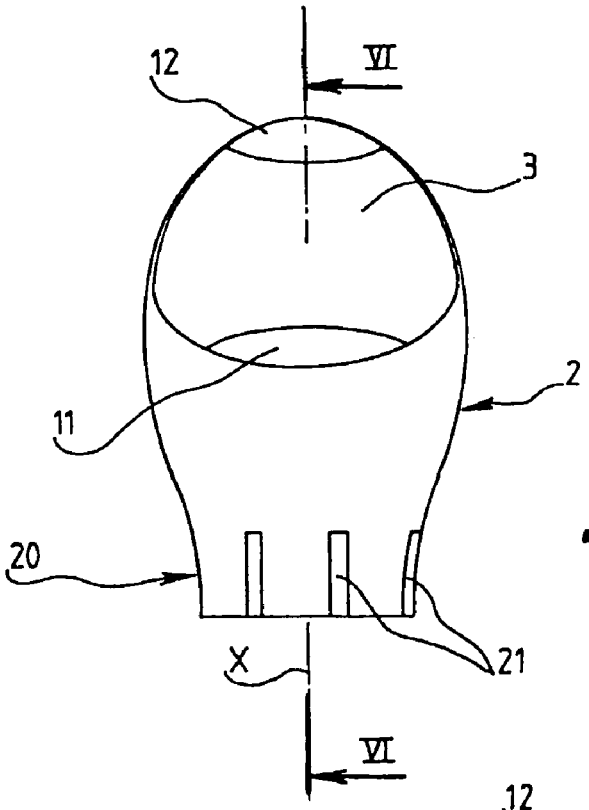
FIG. 5 is a view similar to FIG. 2, illustrating a drinking cup according to a second embodiment of the invention.

Furthermore, as shown in FIGS. 2, 4 and 5, each of the slots thus forming air inlet 11 and mouth opening 12 is curved, and has a concavity facing away from axis X.

As shown furthermore in FIGS. 1 and 6, closing wall 3 can be at least approximately made up of a portion of a cylinder of large radius and have a slight concavity facing away from beverage inlet 10.

The ideal form of the drinking cup is obtained by giving wall 2 with annular cross section, at least locally, a flaring that decreases along the axial direction D (FIGS. 1, 3 and 6) moving from beverage inlet 10 towards closing wall 3.

In other words, angle C in FIG. 3, formed by axis X and tangent T to wall 2 with annular cross section at any point of this wall, becomes smaller as the distance separating this point from beverage inlet 10, measured along axis X, increases.

Angle C, assumed to be oriented, can even become negative close to mouth opening 12, the flaring out of the cup being therefore followed by a narrowing, forming a basin in wall 2 capable of collecting a certain volume of beverage.

The drinking cup of the invention can be made up of one or more materials, at least one of which can be a thermoplastic polymer, and can be produced at least partially by molding.

FIGS. 1 to 6 illustrate in a non-limiting manner the case with which walls 2 and 3 are produced out of a material that is rigid at room temperature.

In this case, the cup of the invention preferably has flexible joint 4, for example, made from an elastomeric material, making it possible to fit beverage inlet 10 of the cup tightly on neck G of bottle B.

As shown in FIGS. 1 and 6, joint 4 can be in the form of a sleeve so as to surround neck G at least partially, and to penetrate partially into wall 2 with annular cross section (FIG. 1) or to be arranged in its base 20 (FIGS. 5 and 6).

In the latter case, cut-outs 21 are advantageously provided in base 20 to make elastic deformation of this base and mounting of the cup on neck G possible.

However, it is also possible to reduce flexible joint 4 to a single washer resting in a sealed manner on an internal flange such as 22 of wall 2, with it being then possible for the cup to be held on neck G by cut-outs such as 21 made in base 20 of wall 2.

The use of joint 4 can even prove superfluous if the manufacturing tolerances of the bottles used are sufficiently exacting, or if the cup is produced of a flexible material, for example, food-quality polypropylene.

Figure 7:
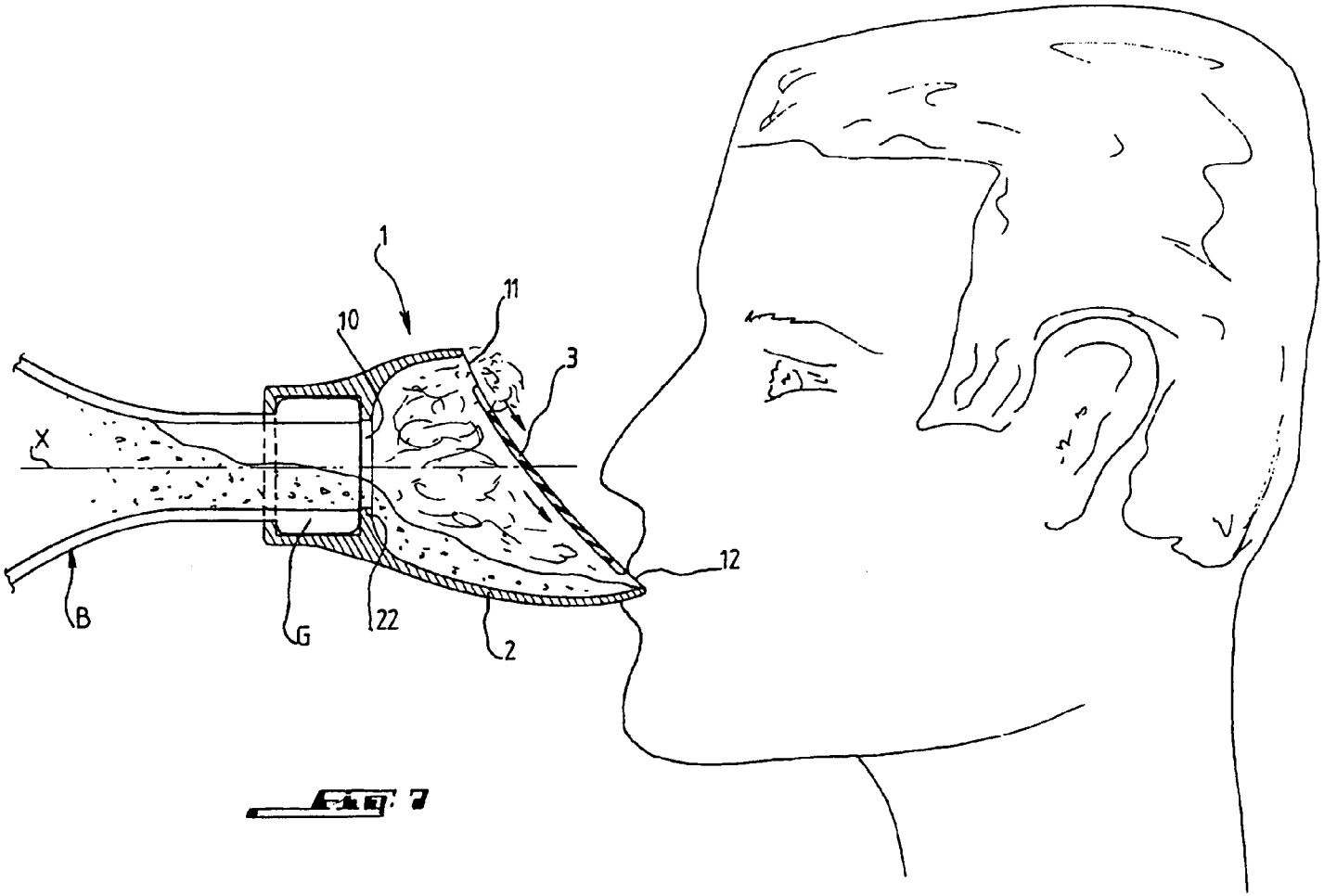
FIG. 7 is a view in axial section of a cup produced from a flexible material, and which is represented in the process of being used.

FIG. 7 illustrates a drinking cup of precisely this type, in the process of being used by a consumer.

As indicated in the preceding, the drinking cup of the invention is ideally applicable to the tasting of a beverage in bottle B, in particular champagne. The explanation is the following.

In a first step, the bottle is uncorked normally, and the cup of the invention is attached onto neck G of the bottle. Under normal conditions, there is no untimely production of foam.

In a second step, the consumer inclines the whole formed by the bottle and the cup and brings the latter to his mouth at the site of mouth opening 12. At this time, the liquid leaves the bottle and runs over the internal surface of wall 2, and this is also the time during which a large quantity of foam can be produced, which is capable of filling the interior volume of the device and even escaping of through opening 11 then situated in high position.

The foam that hits the internal surface of wall 3 breaks up, and the liquid that forms runs in the direction of mouth opening 12.

The foam that possibly escaped through opening 11 falls back and breaks up on the external surface of wall 3, and the liquid which forms runs over this external surface also in the direction of mouth opening 12.

It should be noted that the device of the invention is particularly suited to tasting champagne and sparkling wines whose pressure (on the order of 2.5 to 5 kg) is much greater than the pressure of other semi-sparkling beverages, such as sodas or beer, which generally does not exceed 1 kg.

The invention claimed is:

1. A drinking cup for consuming a beverage directly from a container holding the beverage, comprising:

a hollow body penetrated by a beverage inlet centered on an axis, an air inlet, and a mouth opening, the hollow body having a wall with an annular cross section surrounding the axis, and a closing wall connected to the wall with an annular cross section, oblique with respect to the axis, and having the air inlet and the mouth opening, respectively relatively near and relatively far from the beverage inlet in an axial direction, the air inlet and the mouth opening being contiguous to the wall with an annular cross section and to the closing wall, wherein the wall with an annular cross section is a surface of revolution which flares outward from the beverage inlet, and a mid-plane joining the air inlet to the mouth opening forms, with the axis, an angle which is, at most, 60 degrees.

2. The drinking cup according to claim 1, wherein the air inlet and the mouth opening are both contiguous to the wall with an annular cross section and to the closing wall.

3. The drinking cup according to claim 1, wherein the air inlet is slot in the closing wall.

4. The drinking cup according to claim 3, wherein the slot forming the air inlet is curved and has a concavity facing away from the axis.

5. The drinking cup according to claim 3, wherein the mouth opening is a slot in the closing wall.

6. The drinking cup according to claim 5, wherein the slot forming the mouth opening is curved and has a concavity facing away from the axis.

7. The drinking cup according to claim 1, wherein the closing wall has a concavity facing away from the beverage inlet.

8. The drinking cup according to claim 1, wherein the angle formed by the mid-plane joining the air inlet with the mouth opening is between 30 and 60 degrees.

9. The drinking cup according to claim 1, wherein the surface of the wall with an annular cross section flares outward and flaring of the wall decreases with increasing distance from the beverage inlet.

10. The drinking cup according to claim 9, wherein the flaring of the surface of the wall with an annular cross section is followed by a narrowing of the surface.

11. The drinking cup according to claim 1, made at least partially of a flexible material, which can be fitted onto a container to form a seal.

* * * * *